United States Patent [19]

Rhodes

[11] Patent Number: 5,065,678

[45] Date of Patent: Nov. 19, 1991

[54] CONVEYOR SYSTEM WITH TRANSVERSE PUSHER TO TRANSFER LOAD CARRIER BETWEEN SEPERATE CONVEYING PATHS

[76] Inventor: Arthur B. Rhodes, 3347 Camp Ground Rd., Louisville, Ky. 40211

[21] Appl. No.: 566,832

[22] Filed: Aug. 14, 1990

[51] Int. Cl.[5] ..... B61J 3/04

[52] U.S. Cl. ..... 104/88; 104/96; 104/172.2; 198/465.1

[58] Field of Search ..... 104/88, 96, 101, 130, 104/172.1, 172.2, 172.3; 198/465.1, 803.01

[56] References Cited

U.S. PATENT DOCUMENTS

| | | | |
|---|---|---|---|
| 2,894,460 | 7/1959 | Klamp | 104/88 |
| 2,965,043 | 12/1960 | Klamp et al. | 104/88 |
| 3,146,874 | 9/1964 | McGow et al. | 104/88 X |
| 3,174,439 | 3/1965 | Edgar et al. | 104/88 |
| 3,407,751 | 10/1968 | Orwin | 104/172.2 |
| 3,430,580 | 3/1969 | Edens | 104/88 X |
| 4,438,702 | 3/1984 | Rhodes | 104/172.2 X |
| 4,638,740 | 1/1987 | Rhodes | 104/172.2 |
| 4,644,869 | 2/1987 | Rhodes | 104/172.2 |
| 4,770,285 | 9/1988 | Rhodes | 198/378 |

*Primary Examiner*—Robert J. Oberleitner
*Assistant Examiner*—S. Joseph Morano
*Attorney, Agent, or Firm*—Charles G. Lamb

[57] ABSTRACT

A conveyor system having at least two conveyor tracks for moving load carrying units to different locations within a facility in which the conveyor system as installed, includes a device for selectively engaging and disengaging the load carrying units to and from the conveyor tracks, and a device for selectively pushing the load carrying units out of alignment with one of the conveyor tracks and into alignment with the other one of the conveyor tracks.

12 Claims, 4 Drawing Sheets

CONVEYOR SYSTEM WITH TRANSVERSE PUSHER TO TRANSFER LOAD CARRIER BETWEEN SEPERATE CONVEYING PATHS

BACKGROUND OF THE INVENTION

The present invention relates to conveyor systems, and more particularly, a conveyor system having two continuously moving conveyors for moving load carrying units therealong with a device for selectively moving load carrying units from one conveyor to the other without stopping either one of the conveyors.

Conveying systems are typically used in manufacturing facilities to move workpieces through workstations located along a conveying path.

Conveying systems known to me for moving workpieces from workstation to workstation include conveyors which generally move at a constant speed and include load carrying units which can be coupled for movement therewith between workstations and uncoupled from the conveyor so that they will be stationary at the workstations while work is done on a workpiece carried by the load carrying units. Examples of patents directed to such conveying systems include U.S. Pat. No. 4,438,702; U.S. Pat. No. 4,644,869; U.S. Pat. No. 4,638,740; and U.S. Pat. No. 4,770,285.

Further, known conveyor systems also include two or more conveyors which are used to move load carrying units to different locations in a manufacturing facility. It is a problem to move load carrying units from one conveyor to another conveyor without stopping the conveyors.

SUMMARY OF THE INVENTION

The present invention recognizes the problem in moving load carrying units from one moving conveyor to another moving conveyor without stopping either of the conveyors or in anyway interfere with the movement of other load carrying units being moved simultaneously on either conveyor.

More particuarly, the present invention provides a conveyor system comprising a first conveyor track defining a first conveyor path; a second conveyor track defining a second conveyor path, a portion of the length of the second conveyor path being in close proximity to a portion of the length of the first conveyor track; at least one load carrying unit movable with said first conveyor track and said second conveyor track; conveyor track engaging and disengaging means associated with each load carrying unit for movement between a conveyor track engaging position engaging the individual load carrying units to one or the other of said first and second conveyor tracks with which the load carrying unit is aligned for movement therewith, and a conveyor track disengaged position disengaging the individual load carrying unit from said first or second conveyor track; activating means located in the area whereat said first and second conveyor tracks are in close proximity to each other, said activating means being movable between a first position whereat it activates said load carrying unit engaging and disengaging means to the conveyor track disengaged position for disengaging said load carrying unit from the aligned one of said first or second conveyor tracks when said load carrying unit is at said activating means, and a second position whereat it activates said load carrying unit engaging and disengaging means to the conveyor track engaging position for engaging said load carrying unit to said first or second conveyor track; first control means for operating said activating means to said first position as a load carrying unit with the aligned one of said first or second conveyor tracks approaches said activating means; pusher means located near said activating means for pushing said load carrying unit at said activating means out of alignment with one or the other of said first and second conveyor tracks and into alignment with the other one of said first and second conveyor tracks; second control means for operating said pusher means to push said load carrying unit at said activating means out of alignment with one of said first and second conveyor tracks and into alignment with the other one of said first and second conveyor tracks; and third control means for operating said activating means to said second position when said load carrying unit has been pushed by said pusher means out of alignment with one of said first and second conveyor tracks and into alignment with the other one of said first and second conveyor tracks for engaging the load carrying unit with the other one of said conveyor tracks for movement therewith.

BRIEF DESCRIPTION OF THE DRAWING

A better understanding of the invention will be had upon reference to the following description in conjunction with the accompanying drawings, wherein like numerals refer to like parts throughout the several views and wherein.

DETAILED DESCRIPTION OF THE PREFERRED EMBODIMENT

Figures 1, 7:
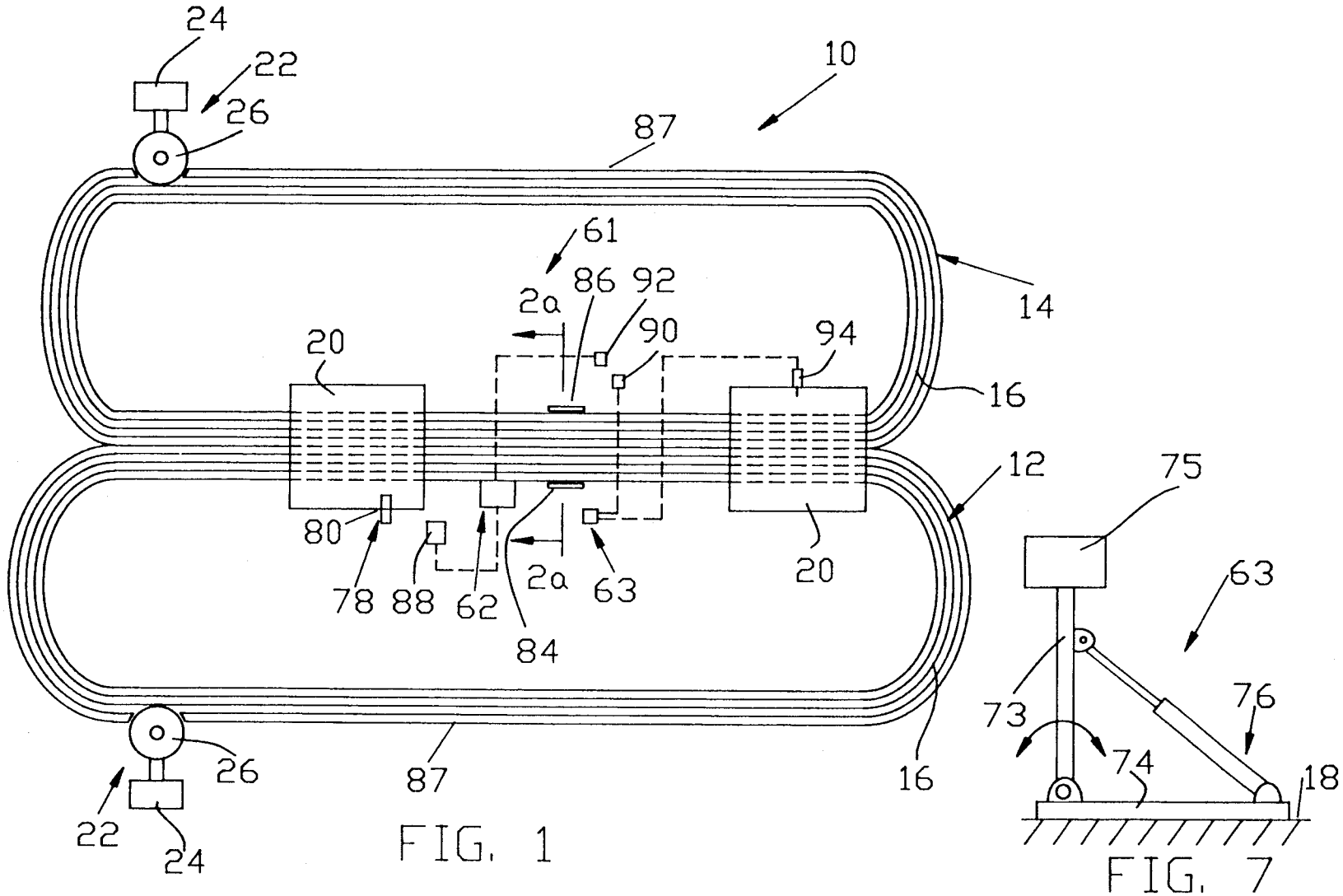
FIG. 1 is a plan view of a conveyor system of the present invention.
FIG. 7 is an enlarged side view of another component of the conveyor system.

FIG. 1 schematically shows a conveyor system, generally denoted as the numeral 10, incorporating features of the present invention. The conveyor system 10 is shown as including two separate closed loop conveyor tracks such as a first conveyor track 12 and a second conveyor track 14 defining two separate conveying paths. The first and second conveyor tracks 12 and 14 are essentially identical, and each includes an endless chain 16 having interlocking chain links which move along the floor 18 of a facility.

Load carrying units 20 are coupled or engaged to the conveyor track 12 and track 14 for movement therewith. The conveyor system 10 further includes means 22 for moving each of the endless conveyor chains 16 of the track 12 and the track 14. Such a moving means 22 can be, for example, an electric motor 24 having a sprocket 26 attached to its output shaft with the sprocket 26 in meshing engagement with the endless chain 14 of the track 12 and the track 14. It should be clearly understood that while the conveyor track 12 and the track 14 are illustrated as being located on the floor of a facility, it is contemplated that the conveyor track 12 can also be located as an overhead conveyor track, or in the floor.

Figure 2:
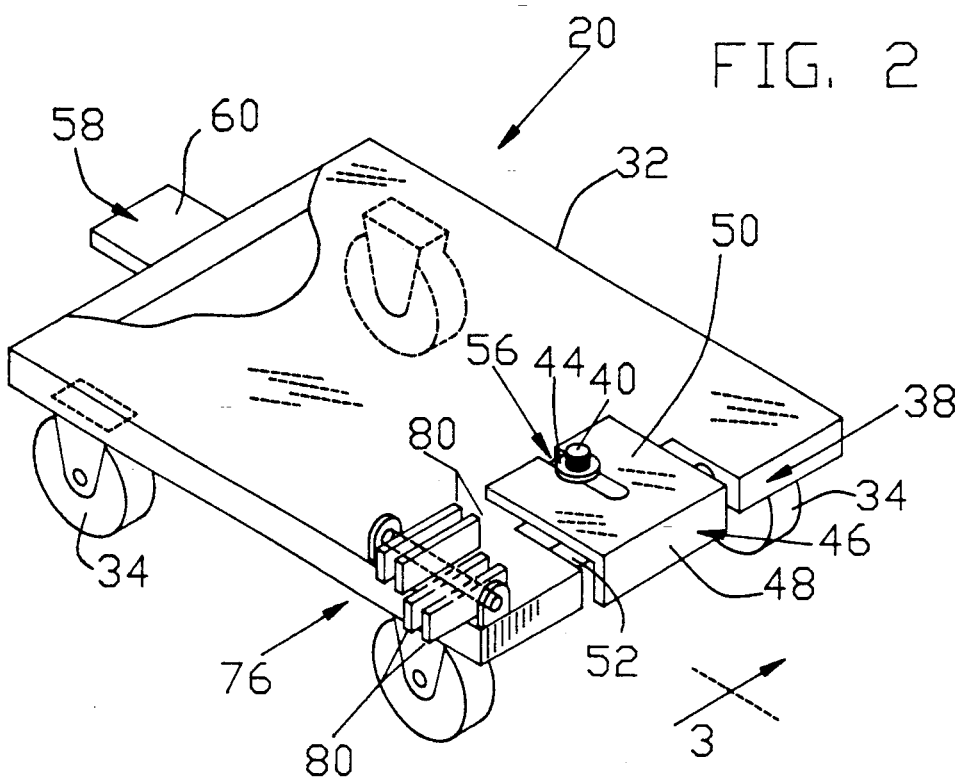
FIG. 2 is a perspective view of a load carrying unit movable with the conveyor system for carrying workpieces.

Now with reference to FIG. 2, there is shown a perspective view of one example of a load carrying unit 20 which can be used with the conveyor system 10. As shown, the load carrying unit 20 includes frame structure 32 and floor engaging wheels 34 rotatably attached to the frame structure 32. The frame structure 32 can be of virtually any construction and configuration to support a load to be carried and conveyed on the unit 20. With continued reference to FIG. 2 and additional reference to FIG. 3, the load carrying unit 20 further includes means generally denoted as the numeral 38 for selectively engaging and disengaging the unit 20 to and from the conveyor chains 16 of the conveyor track 12 and conveyor track 14. As shown, the conveyor chain engaging-disengaging means 38 includes a depending movable conveyor chain engagement pin 40 attached to the frame 32 near the front end of the unit 20. The movable chain engagement pin 40 is movable between a lowered, conveyor chain engaged position (shown in broken lines in FIG. 2*a*) and a raised, vertically displaced conveyor chain disengaged position (shown in solid lines in FIG. 2*a*). In the lowered, conveyor chain engagement position the depending end of the pin 40 is received in the opening of one of the horizontal links of the conveyor track chain 16, and in the raised conveyor chain disengaged position the depending end of the pin 40 is spaced a distance above and out of contact with the conveyor track chain 16 so that the conveyor track chain 16 moves beneath the depending end of the pin 40. As can be best seen in FIG. 3, the pin 40 of the chain engaging-disengaging means 38 moves in a coaxial sleeve 41 which is attached to the frame structure 32 and depends in coaxial relationship with the pin 40. The depending end of the sleeve 41 is spaced above the chain 16 of the conveyor tracks 12 and 14.

Figure 3:
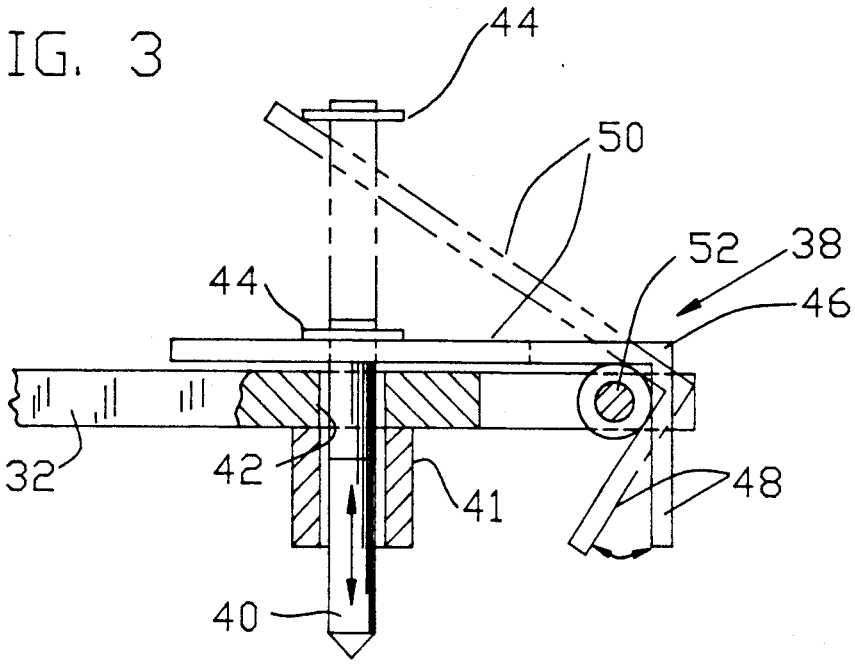
FIG. 3 is an enlarged side view of an element of the load carrying unit of FIG. 2.
Figure 4:
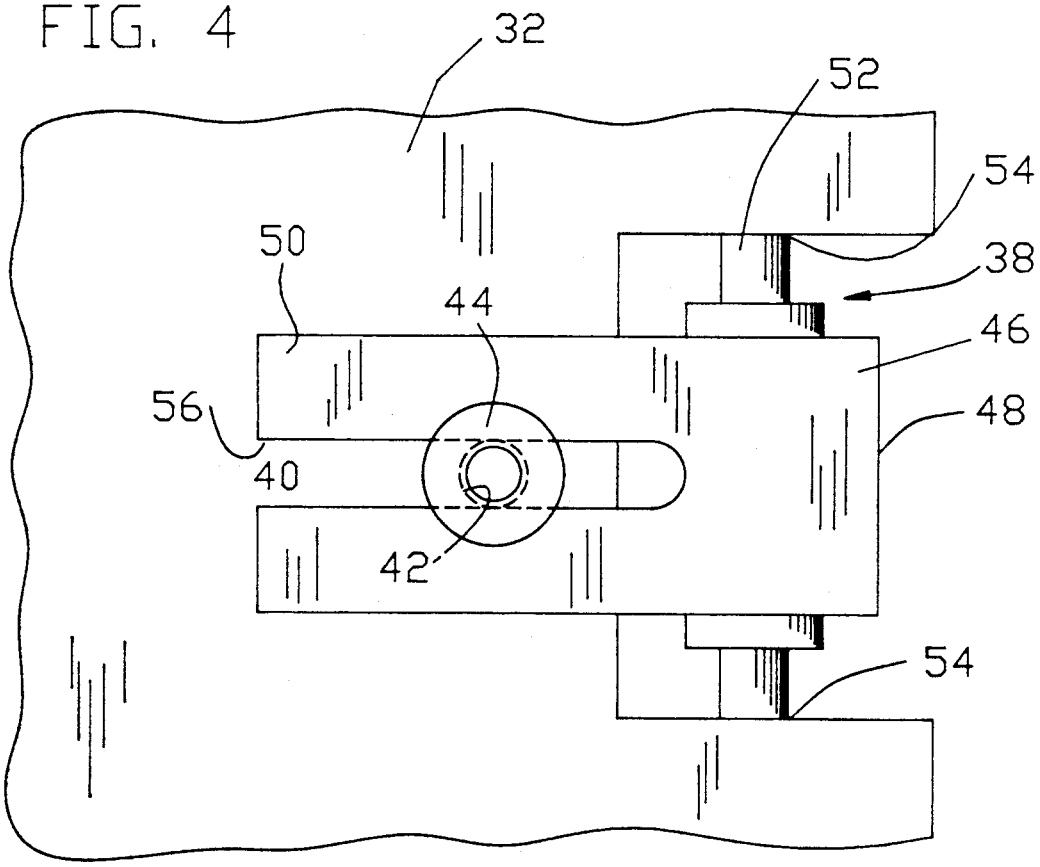
FIG. 4 is an enlarged top view of the element of FIG. 3.

Various constructions can be used to movably attach the movable pin 40 to the frame structure 32. As shown in FIGS. 2, 3 and 4, the movable pin 40 is axially, slidably received through a hole 42 in the frame 32 to depend vertically from the frame 32. A portion of the pin 40 also extends above the frame 32, and a keeper 44 is attached to the pin 40 proximate the upwardly extending end thereof. A pivotable right angled plate 46 is located at the front of the load carrying unit 20 in front of the pin 40. The angled plate 46 includes a first arm 48 and a second arm 50 at a right angle to the frist arm 46. A pivot axle 52 is located across the plate 46 at the junction of the first arm 48 and second arm 50 and is affixed thereto so that the plate 46 will move with the axle 52 as it rotates. The opposite ends of the axle 52 extend beyond the opposite lateral sides of the plate 46 and are received in appropriate holes 54 in the frame 32 for rotational movement therein. The first arm 48 depends from the axle 52 at the front of the load carrying unit 20 and the second arm 50 extends back from the axle 52 to the location of the movable pin 40. The second arm 50 is formed with an elongated opening 56. The upwardly extending portion of the pin 40 is received in the elongated opening 56 with the keeper 44 located above the second arm 50 so that it is in abutment with the top side of the second arm 50. The conveyor engagement pin 40 is biased to the lowered conveyor chain engagement position by the force of gravity.

With reference to FIG. 2, the load carrying unit 20 also includes a pin moving device 58 affixed to the rear end of the unit frame 32 for moving the movable conveyor chain engaging pin 40 of a following load carrying unit 20 to the raised conveyor chain disengaged position in the event that a first or leading load carrying unit 20 has been disengaged from the conveyor chain 16 of the track 12 and track 14, and is therefore stationary, and the second or following load carrying unit 20 impacts the rear end of the first load carrying unit 20. The pin moving device 58 is shown as a generally horizontal finger 60 projecting generally horizontally rearwardly from the unit frame 32 at the elevation of the pivoted right angled plate 46. As the second or following load carrying unit 20 approaches a first or leading load carrying unit 20, which is stationary, the horizontal finger 60 projecting from the rear end of the stationary load carrying unit 20 contacts the depending arm 48 of the plate 46 of the second or following load carrying unit 20, thusly, lifting the movable conveyor chain engaging pin 40 of the second or following load carrying unit 20 to the vertically displaced conveyor track disengaged position thereby also disengaging the second load carrying unit 20 from the moving conveyor chain 16 of the conveyor track 12 and track 14 so that it will also stop.

Figure 6:
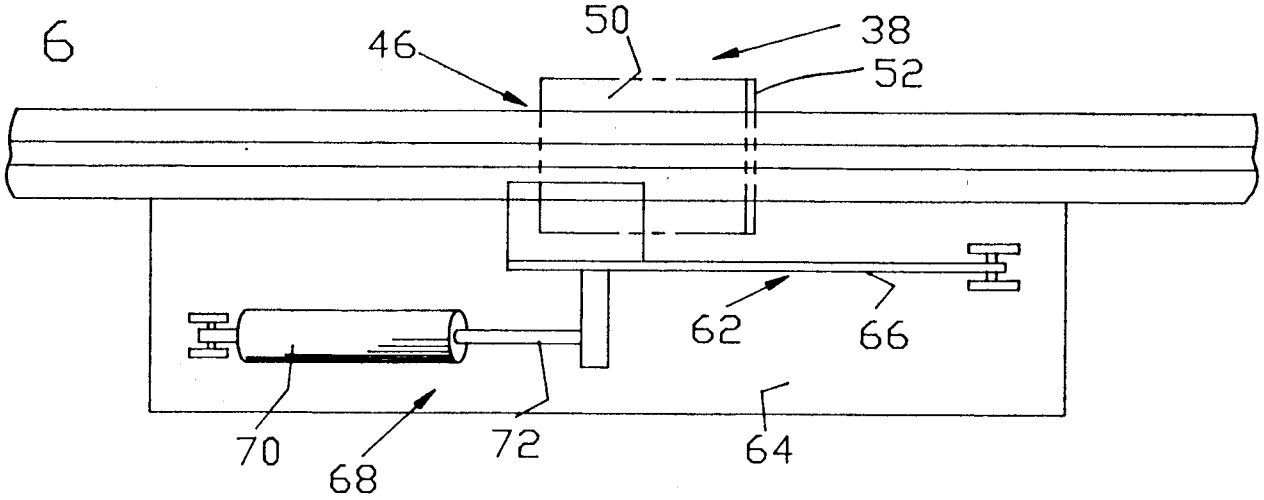
FIG. 6 is an enlarged top view of the component of FIG. 5.
Figure 5:
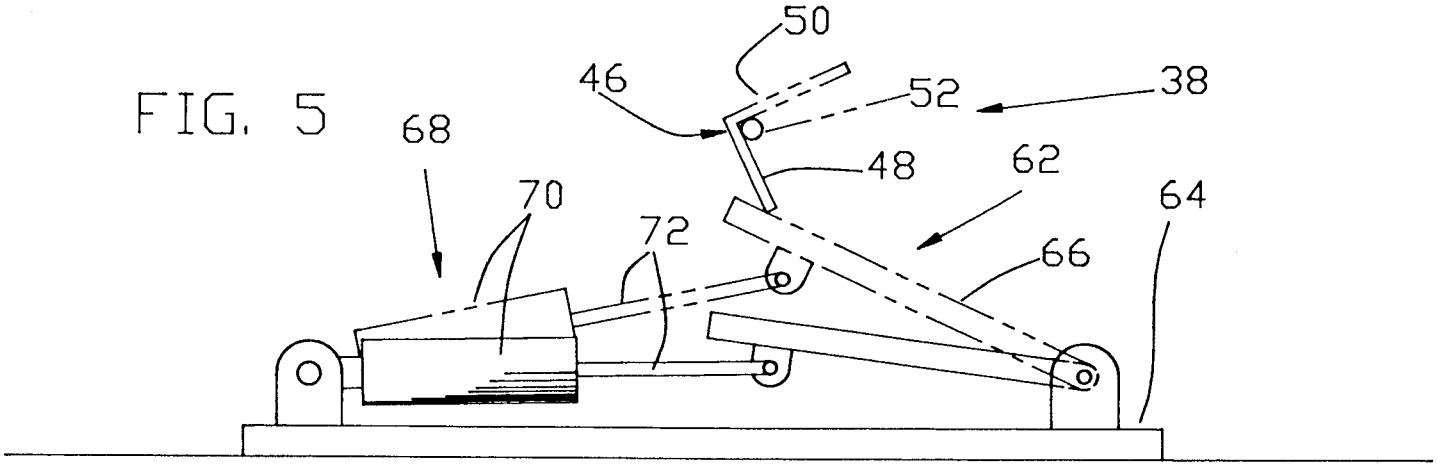
FIG. 5 is an enlarged side view of a component of the conveyor system.

Now, with reference to FIGS. 1, 5 and 6, the conveyor system 10 includes load carrying unit transfer means, generally denoted as the numeral 61, for selectively transferring load carrying units 20 between conveyor tracks 12 and 14. The load transfer station 61 includes load carrying unit activating means, generally denoted as the numeral 62, and load carrying unit pusher means, generally denoted as the numeral 63. The activating means 62 located in an area wherein the tracks 12 and 14 are adjacent each other and function to selectively activate the load carrying unit engaging-disengaging means 38 of the load carrying unit 20 between conveyor chain track engaged and disengaged positions to control or selectively stop the load carrying unit 20 from moving with the conveyor track chain 16 and allow the load carrying unit 20 to move with the conveyor track chain 16. The load carrying unit pusher means 63 is located near the activating means 62 and functions to selectively push a load carrying unit 20 transversely of the conveyor trade chain 16 when the activating means 62 is activated to move the engaging-disengaging means 38 to the conveyor disengaging position, thereby repositioning the load carrying unit 20, and conveyor chain engagement pin 40 of the load carrying unit 20, out of alignment with the conveyor chain 16 of one conveyor track 12 and into alignment with the conveyor chain 16 of the other conveyor track 14.

The activating means 62 is located next to one of the conveyor tracks, for example, the conveyor track 12 at a selected position whereat the conveyor tracks 12 and 14 are adjacent each other. The activating means 62 is shown as including a base 64 on the floor 18 next to the conveyor track 12, a movable arm 66 attached to the base 64, and an arm actuator 68. The movable arm 66 is pivotably attached at one of its ends to the base 64 for pivotable movement in a vertical plane parallel to the conveyor track 12 section adjacent thereto. The arm actuator 68 is shown as a fluid operated cylinder device having its piston cylinder 70 pivotably mounted to the base 64 and the distal end of its operating rod 72 pivotably attached to the movable arm 66 between the pivoted end and free end of the movable arm 66. The fluid operated cylinder device 70 can be selectively operated to extend its operating rod 72 to pivot the movable arm 66 to a first or raised position projecting above the elevation of the depending end of the first arm 48 of the right angled plate 46 of the engaging-disengaging means 38 so it will contact the right angled plate 46, and to retract its operating rod 72 to pivot the movable arm 66 to a second or lowered position beneath the depending end of the first arm 48 of the angled plate 46 of the engaging-disengaging means 38 so it will not contact the right angled plate 46. When the movable arm 66 is in the first or raised position (shown in broken lines in FIG. 5), it contacts the depending first arm 48 of the right angled plate 46 causing the plate 46 to pivot on the axle 52. The second arm 50 is thusly moved upwardly in an arcuate motion centered on the axle 52 raising or lifting the pin 40, by the keeper 44, to the vertically displaced conveyor chain disengaged position as shown in broken lines in FIG. 3. When the movable arm 66 is in the second or lowered position (shown in solid lines in FIG. 5), it does not contact the depending first arm 48 of the right angled plate 46, thus allowing the pin 40 to remain in or drop vertically back to the lowered conveyor chain engaged position as shown in solid lines in FIG. 3.

With reference to FIG. 7, there is shown an example of the pusher means 63. As shown, the pusher means 63 includes an upstanding arm 73 pivotably attached at its bottom end to a mounting plate 74 which is secured to the facility floor 18, and a load carrying unit impact head 75 is mounted to the top end of the upstanding arm 73. The upstanding arm 73 is caused to pivot by means of an arm actuator 76 such as a fluid operated cylinder device. The fluid operated cylinder device 76 has its operating rod connected to the upstanding arm 73 and its cylinder connected to the mounting plate 74. The pusher means 63 is located next to the conveyor chain 16 of the track 12 so that when the pusher means 63 is actuated, the operating rod of the cylinder device extends causing the upstanding arm 73 to pivot toward the conveyor chain 16 and when the pusher means 63 is deactivated, the operating rod of the cylinder device retracts so that the upstanding arm 73 is pivoted away from the conveyor chain 16. When the pusher means 63 is actuated, the impact head 75 moves against the frame of the load carrying unit 20 located adjacent the pusher means 63 thereby pushing the load carrying unit 20 transversely of the conveyor tracks 12 and 14 as is hereinafter discussed in detail.

As shown in FIGS. 1 and 2, each load carrying unit 20 includes limit switch engagement means, generally denoted as the numeral 76, for activating various limit switches of the load carrying unit transfer station 61 as will hereinafter be discussed in detail. As shown, the limit switch engagement means 78 comprises a flag 80 attached to the top side of the load carrying unit frame structure 32. The flag 80 is pivotably attached at one of its ends to the load carrying unit frame structure 32 so that it can selectively be pivoted between an inoperative position shown in phantom lines in FIGS. 1 and 2, wherein it does not project beyond the side edge of the load carrying unit 20 and an operative position shown in solid lines in FIGS. 1 and 2, wherein it does project tyransversely outwardly beyond the side edge of the load carrying unit 20.

Figure 2A:
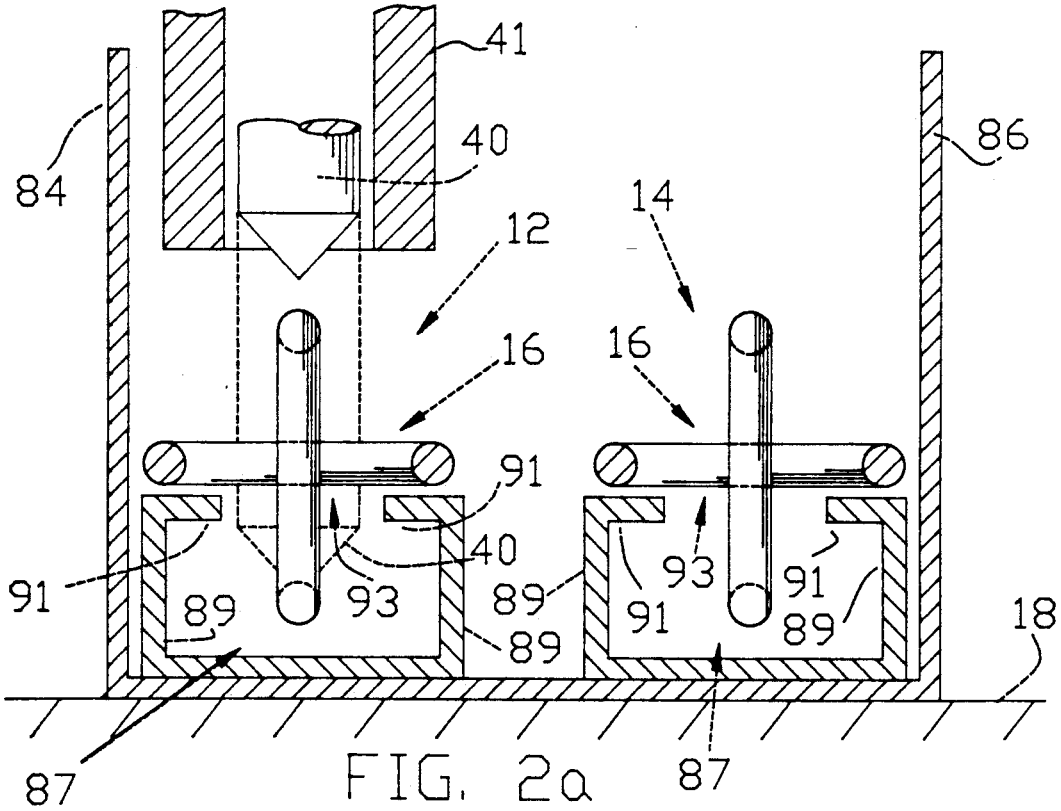
FIG. 2*a* is an enlarged transverse cross-sectional view of the conveyor system as seen in the direction of arrows 2*a*—2*a* in FIG. 1.

With reference to FIG. 2*a*, there is shown a transverse cross-sectional view of the conveying system 10 in the load carrying unit transfer station 61. As shown, the conveyor chains 16 of the conveyor tracks 12 and 14 are closely adjacent. In addition, two spaced-apart, parallel, vertical stop partitions 84, 86 are positioned to either lateral side of the conveyor system 10 such that one vertical partition 84 is spaced from and parallel to the conveyor chain 16 of one conveyor track 12 and the other vertical partition 86 is spaced from and parallel to the conveyor chain 16 of the other conveyor track 14. The vertical partitions 84 and 86 longitudinally extend essentially the length of the load carrying unit transfer station 61 and are located adjacent the load carrying unit pusher means 63. The vertical partitions extend upwardly from the floor 18 to an elevation above that of the bottom end of the sleeve 41 of the load carrying units 20, but below that of the bottom side of the load carrying unit frame structure 32. In addition, the partition 84 is spaced from the longitudinal centerline of the conveyor chain 16 of the conveyor track 12 by a distance approximately equal to, or only slightly greater than, the radius of the sleeve 41 and the partition 86 is spaced from the longitudinal centerline of the conveyor chain 16 of the conveyor track 14 by a distance approximately equal to, or only slightly greater than, the radius of the sleeve 41. The partitions 84 and 86 coact with the sleeve 41 of a load carrying unit 20 to properly locate the pin 40 of that load carrying unit centered over the conveyor chains 16 of one or the other of the conveyor tracks 12 and 14 when a load carrying unit 20 is transferred by the load carrying unit transfer pusher 63 from one of the conveyor tracks to the other of the conveyor tracks as will hereinafter be discussed in more detail.

With reference to FIGS. 1 and 2*a*, each conveyor track 12 and 14 includes a conveyor chain guide channel 87 for guiding the chains 16 about the closed loop defining the two separate conveying paths. The channels 87 are disposed in side-by-side relationship and extend between the vertical partitions 84 and 86. Each channel 87 includes a pair of parallel spaced apart side walls 89, and two cantilevered top flanges 91 extending toward each other from opposite side walls 89 defining a slot 93 between the distal ends of the top flanges 91. As shown, the chain 16 is comprised of alternating vertical and horizontal links. The horizontal links of the chain 16 slide on the top side of the top flanges 91 of the channel 87 and the vertical links travel in the slot 93. As a load carrying unit 20 travels with the chain 16 of the conveyor tracks 12, 14, into the load carrying unit transfer station 61 at the pusher means 63, the sleeve 41 of the load carrying unit 20 in which the pin 40 moves, is closely adjacent one or the other of the vertical partitions 84 or 86 of the conveyor track 12 or 14 to further guide the load carrying unit into the transfer station so that no lateral loads are applied to the movable pin 40 which could cause the pin 40 to bind.

As can be best seen in FIG. 1, the load carrying unit transfer station 61 further includes various limit switches operatively associated with the activating means 62 and the load carrying unit pusher means 63. As the load carrying units 20 move toward, into, and out of the load carrying unit transfer station 61, the limit switch engagement means 78 of the load carrying units 20 sequentially contacts the various limit switches to properly, sequentially operate the pusher means 63 to move the load carrying units between conveyor track 12 and conveyor track 14. The load carrying unit transfer station 61 includes a first limit switch 88 located upstream of the activating means 62 next to the conveyor track 12 at a position to be contacted by the limit switch engagement means 76 of a load carrying unit when in the operative position. The first limit switch 88 is operatively connected to the activating means 62 to operate the activating means 62 to activate the load carrying unit engagement-disengagement means 38 when a load carrying unit 20 passes by and the first limit switch 88 is operatively associated with the fluid operated cylinder 70 of the arm activator 68 to extend the operating rod 72 thereby raising the movable arm 66 of the activating means 62. A second limit switch 90 is located next to the conveyor system 10, generally in alignment with the load carrying unit pusher means 63, at a position to be contacted by the frame structure 32 of a load carrying unit 20 which has moved into position in the transfer station 61 whereat the movable pin 40 of that load carrying unit 20 is located between the partitions 84, 86 and the load carrying unit 20 is in position to be contacted by the pusher means 63 when it is actuated. The second limit switch 90 is operatively connected to the pusher means 63 to operate the pusher means 63 when a load carrying unit 20 contacts the second limit switch 90. More specifically, the second limit switch 90 is operatively associated with the fluid operated cylinder of the arm actuator 76 to cause the operating rod to extend toward the conveyor system thereby pivoting the upstanding arm 73 toward the conveyor system 10 moving the impact head 75 into contact with the load carrying unit 20 to push the load carrying unit transversely of the conveyor chains 16 of the conveyor tracks 12 and 14. A third limit switch 92 is also located next to the conveyor system across from the pusher means 63 and is positioned so that a load carrying unit 20 which has been pushed out of alignment with the track 12 and into alignment with the track 14 will contact the third limit switch 92 when the load carrying unit 20 is in alignment with the track 14. The third limit switch 92 is operatively connected to the activating means 62, and more particularly the fluid operated cylinder 70 thereof, to retract the operating rod 72 thereby lowering the movable arm 66 of the actuating means 62. A fourth limit switch 94 is located downstream of the activating means 62 next to the conveyor track 14 at a position to be contacted by the limit switch engagement means 76 of a load carrying unit when in the operative position. The fourth limit switch 94 is operatively connected to the pusher means 63, and more particularly the fluid operated cylinder of the arm actuator 76 to cause the operating rod to retract away from the conveyor system 10 thereby pivoting the upstanding arm 73 away from the conveyor system 10 to set the pusher means 63 in a ready position to push the next load carrying unit 10 from alignment with the track 12 and into alignment with the track 14.

In operation, a load carrying unit 20 moving with the conveyor chain 16 of the track 12 moves past the first limit switch 88 and the limit switch engagement means 78 contacts the first limit switch 88 which raises the movable arm 66 of the activating means 62. The load carrying unit 20 continues to move with the chain 16 of the track 12 until it is positioned with its movable pin 40 between the stop partitions 84, 86 and in alignment with the pusher means 63. At this time, the raised arm 66 of the actuating means 62 contacts the first arm 48 of the pivot plate 46 of the engagement-disengagement means 38 raising the movable pin 40 out of engagement with the chain 16 of track 12 stopping the load carrying unnit 20 in place.

Concurrently, the frame structure 32 of the load carrying unit 20 contacts the second limit switch 90 causing the upstanding arm 73 of the pusher means 63 to pivot toward the conveyor system 10 forcing the impact head 75 against the frame structure 32 of the stopped load carrying unit 20 and pushing the load carrying unit transversely of the tracks 12 and 14 until the sleeve 41 contacts the stop partition 86 adjacent the conveyor chain 16 of the second conveyor track 14. The partition 86 being spaced from the longitudinal centerline of the chain 16 by a distance equal to the radius of the sleeve 41 properly locates the raised movable pin 40 in alignment with the chain 16 of the second track 14. When the load carrying unit 20 is in a position with the pin 40 in alignment with the chain 16 of the second track 14, the frame structure 32 of the load carrying unit 20 contacts the third limit switch 92 which lowers the movable arm 66 of the activating means 62 thereby allowing the movable pin 40 to move downwardly into engagement with the aligned chain 16 of the second track 14 so that the load carrying unit 20 resumes movement with the chain 16 of the second track 14. Finally, as the load carrying unit 20 now moving with the chain 16 of the second track 14 moves past the fourth limit switch 94, the frame structure 32, or limit switch engagement means 78 contacts the fourth limit switch causing the upstanding arm 73 of the pusher means 63 to pivot away from the conveyor system 10 to be in position for the next load carrying unit.

The foregoing description is given primarily for clearness of understanding and no unnecessary limitations are to be understood therefrom for modifications will become obvious to those skilled in the art upon reading this disclosure and may be made without departing from the spirit of the invention or scope of the appended claims.

What is claimed is:

1. A conveyor system, comprising:

a first conveyor track defining a first conveyor path;

a second conveyor track defining a second conveyor path, a portion of the length of said second conveyor path being in close proximity to a portion of the length of said second conveyor track;

at least one load carrying unit movable with said first conveyor track and said second conveyor track;

conveyor track engaging and disengaging means associated with each load carrying unit for movement between a conveyor track engaging position engaging the individual load carrying units to one or the other of said first and second conveyor tracks with which the load carrying unit is aligned for movement therewith, and a conveyor track disengaged position disengaging the individual load carrying unit from said first or second conveyor track;

activating means located in the area whereat said first and second conveyor tracks are in close proximity to each other, said activating means being movable between a first position whereat it activates said load carrying unit engaging and disengaging means to the conveyor track disengaged position for disengaging said load carrying unit from the aligned one of said first or second conveyor tracks when said load carrying unit is at said activating means, and a second position whereat it activates said load carrying unit engaging and disengaging means to the conveyor track engaging position for engaging said load carrying unit to said first or second conveyor track;

first control means for operating said activating means to said first position as a load carrying unit moving with the aligned one of said first or second conveyor tracks approaches said activating means;

pusher means directly engaging said load carrying unit and fixedly located near said activating means for pushing said load carrying unit at said activating means out of alignment with one of said first and second conveyor tracks and into alignment with the other one of said first and second conveyor tracks;

second control means for operating said pusher means to push said load carrying unit at said activating means out of alignment with one of said first and second conveyor tracks and into alignment with the other one of said first and second conveyor tracks;

third control means for operating said activating means to said second position when said load carrying unit has been pushed by said pusher means out of alignment with one of said first and second conveyor tracks and into alignment with the other one of said first and second conveyor tracks for engaging the load carrying unit with the other one of said conveyor tracks for movement therewith.

2. The conveyor system of claim 1, wherein said first control means is located upstream of said activating means relative to the direction of movement of the conveyor tracks.

3. The conveyor system of claim 2, wherein said first control means is a limit switch.

4. The conveyor system of claim 1, wherein said second control means is located proximate said activating means.

5. The conveyor system of claim 4, wherein said second control means is a limit switch.

6. The conveyor system of claim 1, wherein said third control means is located proximate said activating means.

7. The conveyor system of claim 6, wherein said third control means is a limit switch.

8. The conveyor system of claim 1, wherein said portion of length of said first conveyor path and said portion of length of said second conveyor path are in parallel.

9. The conveyor system of claim 1, further comprising:

a. the conveyor track engaging and disengaging means associated with each load carrying unit comprises:

a depending sleeve attached to the load carrying unit; and, a conveyor track engagement pin received in the depending sleeve for movement therein between a raised conveyor track disengaged position and a lowered conveyor track engaged position engaging one of the first and second conveyor tracks; and, b. a first vertical stop partition located in the area whereat the first and second conveyor tracks are in close proximity to each other, the first partition being disposed laterally to the first conveyor track and spaced from the longitudinal centerline of the first conveyor track by a distance approximately equal to the radius of the depending sleeve of the load carrying unit, the first vertical stop partition for contacting the depending sleeve of the load carrying unit when the load carrying unit has been pushed out of alignment with the second conveyor track to align the load carrying unit with the first conveyor track.

10. The conveyor system of claim 9, wherein the first vertical stop partition extends upwardly to an elevation above the elevation of the depending end of the depending sleeve of the load carrying unit.

11. The conveyor system of claim 9, further comprising:

a second vertical stop partition located in the area whereat the first and second conveyor tracks are in close proximity to each other, the second partition being disposed laterally to the second conveyor track and spaced from the longitudinal centerline of the second conveyor track by a distance approximately equal to the radius of the depending sleeve of the load carrying unit, the second vertical stop partition for contacting the depending sleeve of the load carrying unit when the load carrying unit has been pushed out of alignment with the first conveyor track to align the load carrying unit with the second conveyor track.

12. The conveyor system of claim 11, wherein the second vertical stop partition extends upwardly to an elevation above the elevation of the depending end of the depending sleeve of the load carrying unit.

* * * * *